United States Patent [19]

Cowdrick

[11] 3,977,133

[45] Aug. 31, 1976

[54] METHOD OF FINISHING A FOIL

[76] Inventor: Oakley Cowdrick, 5079 Strawberry Lane, Willoughby, Ohio 44094

[22] Filed: Oct. 29, 1974

[21] Appl. No.: 518,776

Related U.S. Application Data

[62] Division of Ser. No. 451,573, March 15, 1974, Pat. No. 3,863,399.

[52] U.S. Cl. ..... 51/328; 51/151

[51] Int. Cl.[2] ..... B24B 1/00

[58] Field of Search ..... 51/281 R, 328, 149–151, 51/154, 156, 157

[56] References Cited

UNITED STATES PATENTS

| | | | |
|---|---|---|---|
| 413,786 | 10/1889 | Miller | 51/151 UX |
| 2,170,792 | 8/1939 | Brooke | 51/62 |
| 2,759,303 | 8/1956 | Whitehead | 51/151 |
| 2,761,255 | 9/1956 | Dackor | 51/151 |
| 3,355,840 | 12/1967 | Bonning | 51/328 X |

*Primary Examiner*—Harold D. Whitehead
*Attorney, Agent, or Firm*—Teare, Teare & Sammon

[57] ABSTRACT

An apparatus and method for finishing the lengthwise extending edge of a foil including a finishing material mounting assembly for supporting a finishing material and a reciprocating jig assembly for holding the foil so as to position its one edge toward the finishing material and reciprocating the blade in its lengthwise direction simultaneously over one travel distance at one rate and a shorter travel distance at a more rapid rate. The finishing material mounting assembly includes a yieldable pressure means for urging the finishing material into tangential engagement with the edge of the blade. The jig assembly includes a rotatable jig head to enable the foil to rotate about its lengthwise axis, and the pressure means includes a relief means for imparting an oscillating rotating motion to the foil as it is reciprocated and to conform the finishing material to the contour of the foil edge, resulting in a rounded finished edge on the foil.

10 Claims, 6 Drawing Figures

METHOD OF FINISHING A FOIL

REFERENCE TO EARLIER FILED APPLICATION

This is a division of application Ser. No. 451,573 filed Mar. 15, 1974 and now U.S. Pat. No. 3,863,399, issued Feb. 4, 1975.

BACKGROUND OF THE INVENTION

The present invention relates to finishing of a foil, and more particularly, to a method for finishing the rounded lengthwise edge of the foil blade.

There are numerous forms of foils to which this invention is applicable, which are provided in various sizes and shapes for use in different machinery, such as engines, compressors, turbines, or the like and which operate in conjunction with different fluid mediums, such as water, steam, air or the like. In the manufacture of such foils, they are cast, forged, or otherwise preformed to a predetermined shape in accordance with NACA specifications. In this preformed state, the surface of the blades is rough and must be further finished to provide a precise, smooth exterior surface. More particularly, the blades are preformed so as to have rounded lengthwise extending edges. It is extremely important that, in the finished form, these lengthwise edges have an extremely smooth contour so as to be substantially free of any flat spots or corners. Still further, it has also been found desirable to provide an arrangement whereby numerous blades may be finished simultaneously and in a substantially automatic manner while maintaining the high precision that is necessary.

SUMMARY OF THE INVENTION

The present invention contemplates providing an improved method for finishing the lengthwise extending edge of a foil blade. The apparatus for performing the method includes a support structure on which is supported a finishing material mounting assembly for supporting a finishing material, such as a strip of abrasive material, and a reciprocating jig assembly for supporting a turbine blade in confronting relation to the finishing material, and reciprocating the blade in its lengthwise direction. The jig assembly includes a rotatable jig head for holding the blade edge toward the finishing material and enable the blade to rotate about its lengthwise axis. The jig assembly includes a main reciprocating mechanism for reciprocatingly moving the blade in its lengthwise direction transversely of the finishing material, and includes a supplementary vibrating means which imparts a rapid vibratory motion to the blade in its lengthwise direction simultaneously as it is moved by the main reciprocating mechanism 9. The finishing material mounting assembly includes a yieldable pressure means in the form of a pressure block which urges the finishing material into tangential engagement with the edge of the blade. A cam relief means is provided in the form of an elongated, relief cavity formed in the pressure block which enables the finishing material to conform to the contour of the blade edge defining an elongated pocket for receiving the blade edge therein. The cavity is contoured to yieldably support the finishing material in camming engagement with the blade edge to impart an oscillating rotational movement thereto when it is reciprocated. The finishing material mounting assembly further includes a material supply assembly in the form of a pair of reels between which the strip of finishing material extends, and which is adapted for moving the strip from one reel to the other in a direction transverse to the direction of reciprocating movement of the jig head. The pressure block is resiliently biased toward the blade and includes actuation means to enable the pressure block to be moved away from the engine blades to release the pressure on the strip so that the strip can be moved transversely to the lengthwise direction of the blade edge to expose an unused portion of the strip for completing the finishing of one blade or to commence the finishing of a new blade.

This arrangement provides for the efficient and precise finishing of the edge of a blade. In addition, there is provided a substantially automatic arrangement whereby the pressure of the finishing material on the blade and the contact area of the finishing material with the blade is controlled to produce a smoothly contoured edge. Further, this arrangement is highly applicable to mass production requirements so that one operation may finish numerous blades simultaneous in a highly efficient and precise manner.

DESCRIPTION OF THE PREFERRED EMBODIMENTS

Figure 1:
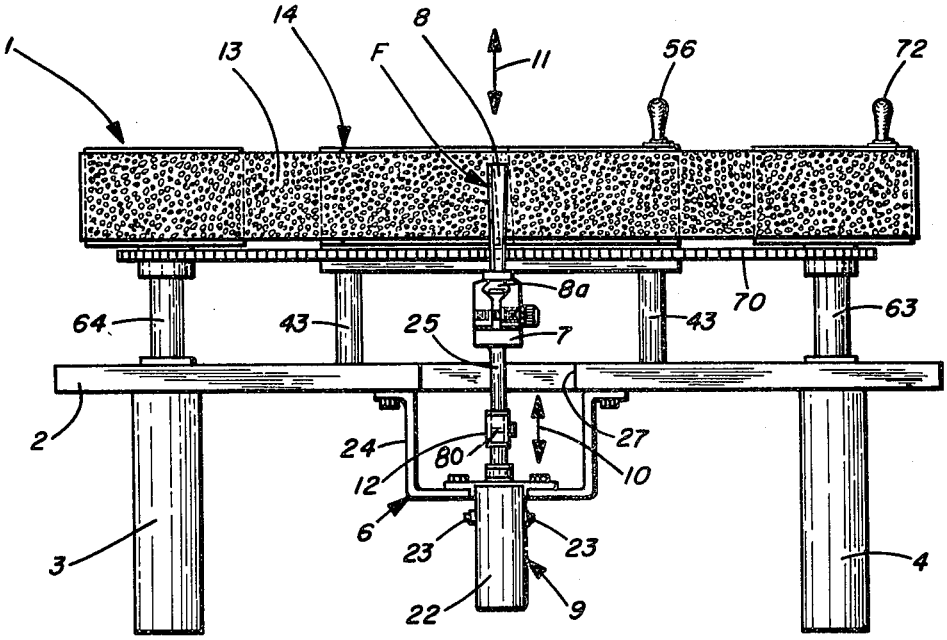
FIG. 1 is a front elevation view of the apparatus of the present invention.

Referring now again to FIG. 1, the apparatus of the present invention is shown, generally at 1, as including a support table 2 having legs 3 and 4. A jig assembly 6 is supported on the table 2 for supporting the blade 8 of a foil F so as to expose at least one lengthwise extending edge, as at **8*a* which may have a length in a range from ¾ to 24 inches. The jig assembly 6 includes a jig head 7 mounted for rotation in a generally horizontal plane and for clampingly engaging the foil base 8*b* to support the blade 8 in a generally vertically-oriented position for rotation about its lengthwise axis. The jig head 7 is mounted on a main reciprocating mechanism 9 being adapted to reciprocate the jig head 7 in a generally vertical direction, as indicated by the arrow heads at 11, to reciprocate the blade 8 in its lengthwise direction, as indicated by the arrow heads 10. The reciprocating mechanism 9 includes a supplementary vibrating mechanism 12 which is operably connected to the jig head 7 to impart a rapid vibrating motion to the jig head 7, and thus, vibrate the blade 8 in its lengthwise direction as it is being reciprocated by the main reciprocating mechanism 9.**

Figure 2:
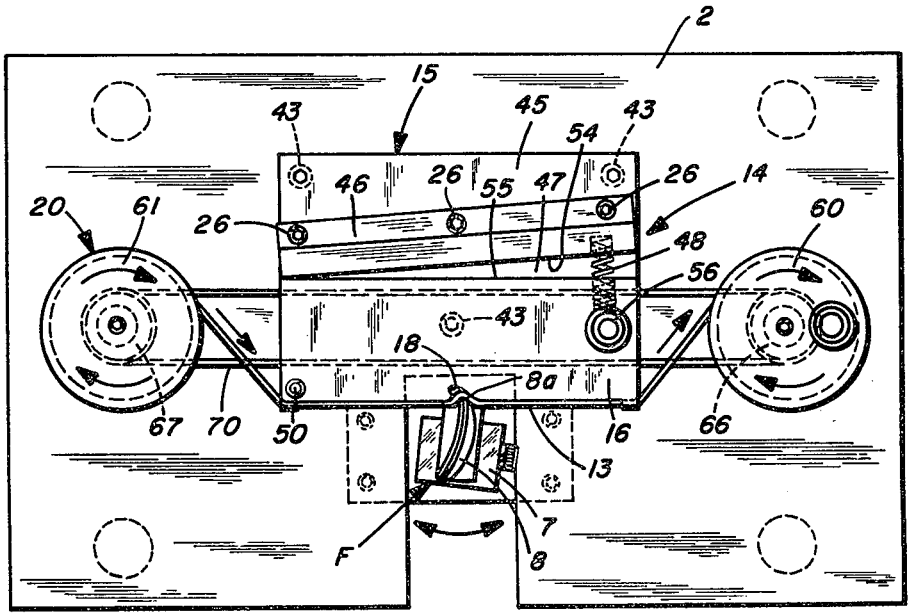
FIG. 2 is a top plan view of the apparatus shown in FIG. 1.

Referring now also to FIG. 2, a finishing material mounting assembly 14 supports a strip 13 of finishing material for engagement with the edge **8*a* when the foil 8 is in the mounted position. The finishing material assembly 14 includes a pressure applicator assembly 15 having a resiliently-based pressure block 16 for urging the strip 13 against the edge 8***a*. The pressure block 16 is formed with a relief cavity 18 which is adapted for alignment with the edge 8*a* of the blade 8, such that when the pressure block 16 is urged toward the blade 8, the edge 8*a* will be disposed within the cavity 18 and deform the strip 13 to the contour of the edge 8*a* defining a yieldable pocket for receiving the blade 8. In addition, the cavity 18 is disposed at a predetermined angular relationship with respect to the vertical direction and the lengthwise dimension of the blade 8 so that the strip 13 will yieldably cammingly engage the blade edge 8*a* to cause oscillating rotating movement of the blade 8 as the jig head 7 is reciprocated. By this arrangement, the strip 13 will be rubbed longitudinally across the entire edge 8*a* of the blade 8 while held in conforming engagement therewith.

Referring again to FIG. 1, the reciprocating mechanism 9 comprises a fluid-actuated cylinder 22 of the reciprocating stroke type, as well known in the art, which is adapted for connection such as at 23, to a suitable source of pressurized fluid. The cylinder 22 is secured to the underside of the table 2 by a bracket 24 and includes an upwardly extending piston rod 25 adapted for reciprocating movement in a generally vertical direction, as indicated by the arrow heads 10. As shown, the table 2 includes an opening defined by a marginal edge 27 through which the rod 25 extends for supporting the jig head 7 above the table 2. The cylinder 22 is preferably of the adjustable stroke type or well known in the art, being capable of adjustment for large strokes over distances in a range from ½ to 3 inches and at a rate of approximately 60 strokes per minute.

Figure 4:
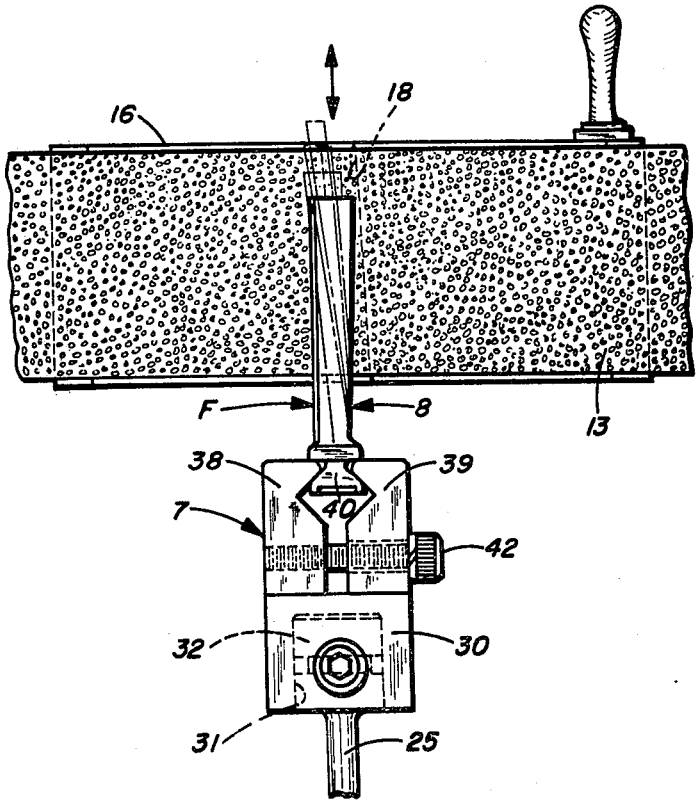
FIG. 4 is an enlarged, fragmentary front elevation view of a portion of FIG. 1 indicating the sequential reciprocating movement of a foil.
Figure 6:
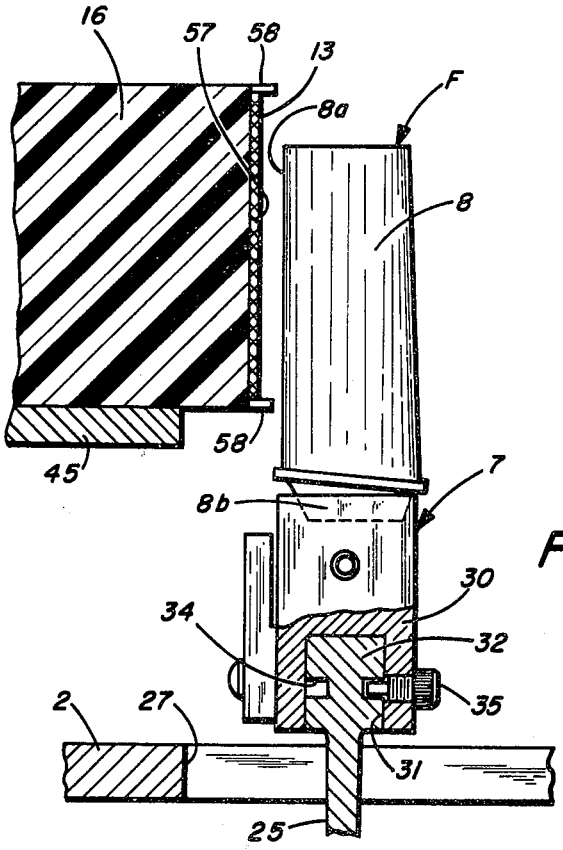
FIG. 6 is an enlarged, fragmentary, transverse sectional view taken along line 6—6 of FIG. 3 with the pressure block in the released position.

Referring now to FIGS. 4 and 6, and jig head 7 includes a base 30 which is swivelly-connected to the upper end of the rod 25. More particularly, the base 30 includes a downwardly opening circular bore 31 for slidably receiving the complementary-shaped upper end 32 of the rod 25. The upper end of the rod 25 is provided with an annular recess 34 and a pin 35 is threaded through the adjacent wall which projects into the bore 31 so as to be disposed in sliding relation within the recess 34. By this arrangement the base 30 is freely rotatable about the upper end of the rod 25 for a reason which will be more fully understood hereinafter. The jig head 7 further includes a pair of oppositely-disposed grip members 38 and 39 which are mounted on the base 30 for movement toward and away from one another, being adapted for clamping engagement with the base 8*b* at one end of the blade 8. As shown, the grip members 38 and 39 are interconnected by an adjustable screw 42 for moving one grip member, such as 39, toward the other grip member 38 for clampingly engaging the base 8*b*. In this regard, it should be pointed out that, when the foil F is mounted in the jig head 7, the edge 8*a* to be finished should be disposed in a substantially vertical orientation, as shown in FIG. 6, so as to extend generally parallel to the general plane of the strip 13, as will be more fully understood hereinafter.

Figure 3:
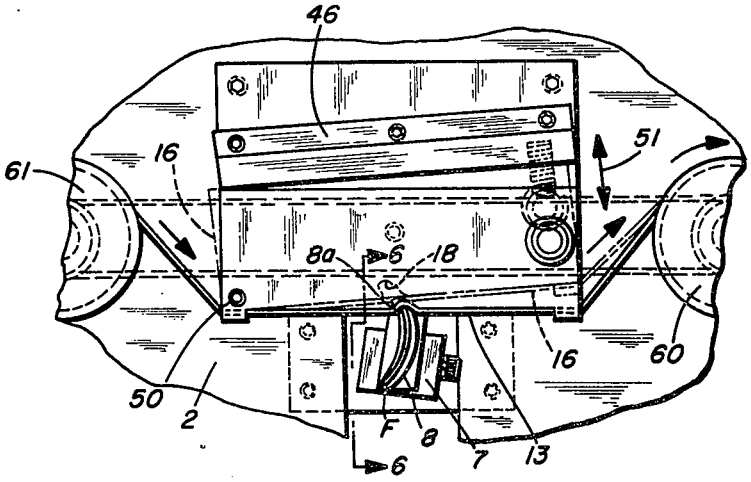
FIG. 3 is a fragmentary portion of FIG. 2 indicating the movement of the pressure block 16 between the pressure applying position and the release position.

The pressure applicator assembly 15 includes a base 45 which is supported above the table 2 posts, such as at 43. A bar 46 is rigidly mounted on the base 45, being secured thereto by screw, such as at 26. The pressure block 16 is mounted forwardly of the bar 46 and is pivotally connected to the base 45 by a pivot pin 50 to enable pivotal movement of the block 16 back and forth in a generally horizontal plane, as indicated by arrowheads 51 in FIG. 3. In this regard, the bar 46 has its forward surface 54 disposed in spaced relation from the rear surface 55 of the block 16 to provide a clearance space 47 therebetween to enable pivotal movement of the block 16 toward the bar 46. In the form shown, the surface 54 extends in angular relation with respect to the surface 55 and provides an abutment for limiting rearward movement of the block 16. A resilient member in the form of a helical spring 48 is supported between the bar 46 and the end of the block 16 remote from the pivot pin 50 for urging the block 16 forwardly toward the blade 8. An actuating knob 56 is mounted on and projects upwardly from the block 16, being adapted to be grasped by an operator for moving the block 16 against the pressure of the spring 48 to a rearward clearance position, such as indicated by the dotted lines at 16 in FIG. 3, and which, upon release thereof, will enable the spring 48 to move the block 16 forwardly to the normal pressure applying position, as indicated by the solid lines at 16 in FIGS. 2 and 3. The spring 48 may be of relatively light weight capable of applying a tension force of 2 to 4 psi on the finishing material.

Referring now to FIGS. 2 and 6, the block 16 is of a generally oblong-shape having a substantially flat front surface 57 for supporting the strip 13 thereon. As shown, projections 58 extend outwardly from the front surface 57 and provide guide elements for guiding the strip 13 along the front surface 57 of the block 16 as will be described more fully hereinafter.

Referring now to FIGS. 1 and 2, strip 13 is supported by a reel assembly 20 which includes a drive reel 60 and a driven reel 61 which are mounted for rotation on posts 63 and 64, respectively, for supporting a strip 13 of finishing material, such as backed carborundum having a 240 grit size. As shown, each of the reels 60 and 61 include a sprocket 66 and 67 adjacent their underside for connecting each in driving relation to a flexible drive element, such as a chain 70, or the like. An actuating knob 72 is mounted on and projects upwardly from the reel 60, being offset with respect to the rotational axis thereof for cranking the drive reel 60. By this arrangement, the reel 60 may initially have a strip of finishing material disposed thereon, and then the material may be threaded between the projections 58 of the block 16 and then around the reel 60. By this arrangement, when the material becomes worn over the area contacting the blade 8, the reel 60 is cranked so as to place an unused area of the strip over the cavity 18 for engagement with the blade 8. Each time the material becomes worn, the reel 60 is indexed to place an unused portion of the strip for engagement with the blade 8 until the entire strip is used. In the indexing operation, the block 16 is moved rearwardly to its release position, as indicated by the dotted lines 16 in FIG. 3, which enables the strip to be easily moved transversely of the blade. Subsequent release of the block 16 will again force the strip against the blade 8 in the manner previously described. Although the indexing mechanism is shown in only a manual mode, it is to be understood that automatic means could be provided to achieve this function. More particularly, such automatic means could be operably connected to the reciprocating mechanism 9 to index the strip after a predetermined number of strokes of the rod 25.

Figure 5:
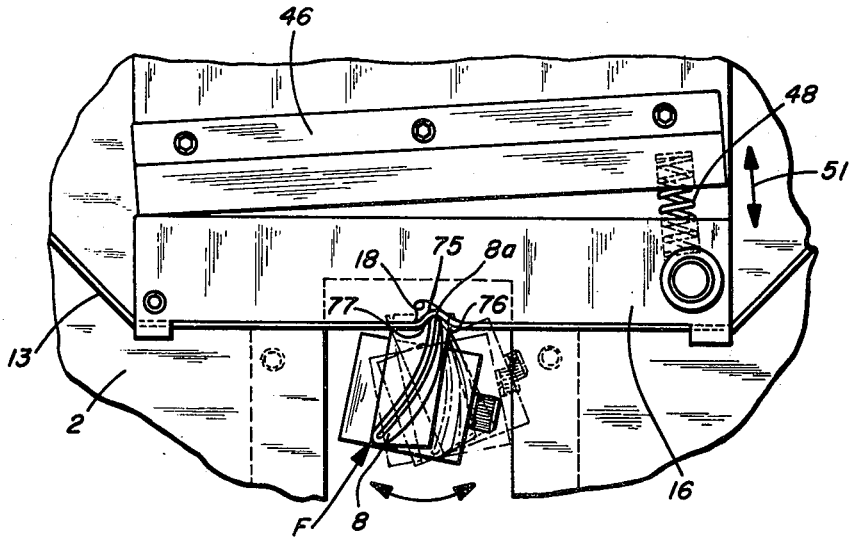
FIG. 5 is an enlarged, fragmentary top plan view of a portion of FIG. 2 indicating the sequential rotational movement of the foil.

Referring now particularly to FIGS. 4 and 5, the cavity 18 is provided in the form of an elongated slot formed in the face 57 of the block 16. As shown in FIG. 4, the slot 18 extends in a slightly angular relationship with respect to the vertical direction, which will depend upon the particular shape of the foil being finished, and being adapted to be aligned with the confronting edge 8*a* of the blade 8 so that the blade 8 can move up and down within the cavity 18 as it is reciprocated. As best shown in FIG. 5, the cavity 18 is defined by an irregularly curved interior surface 75 being deeper toward one side than at the other. The cavity is defined on the shallow side by an interior wall portion 76 which is disposed at an acute angle with respect to the surface 57 and on the deep side by an interior wall portion 77 which is disposed at an obtuse angle with respect to the surface 57. The strip 13 is tensioned so that it will be supported away from the interior wall of the cavity to enable it to yieldably conform to the curvature of the edge 8*a*. By this arrangement, the strip 13 will also cammingly engage the edge 8*a* to rotate the blade 8 as it is reciprocated. In addition, the strip 13 will cover the entire transverse width of the edge 8*a* being disposed tangentially to the curved back side of the blade 8 at the completion of the rotation in one direction, such as in a counterclockwise direction, and in substantially parallel to adjacent portion of the front side of the blade 8 at the completion of rotation of the blade 8 in the opposite or clockwise direction as best shown in FIG. 5. It is to be understood that the block 16 could be provided with more than one cavity 18, and the jig assembly could be arranged for supporting more than one foil F for alignment with each cavity to enable finishing of more than one blade 8 at a time.

The supplementary vibrating mechanism 12 of the reciprocating mechanism 9 may be provided in the form of any well known vibrating mechanism for imparting a short vibrating or reciprocating axial movement to the rod 25 as is it reciprocated by the cylinder 22. In the form shown, the rod 25 is of a split-construction, as at 80, having its upper section and lower section connected by the vibratory mechanism 12. The vibratory mechanism 12 may be of the type manufactured by the Shopmate Company, Model No. 4,000 which has a 3/16 inch travel and vibrates at a rate of 4,000 strokes per minute. In this arrangement, the upper rod sections are maintained in axial alignment with one another and separated a predetermined distance. The mechanism 12 includes interiorly mounted vibrating members which, when the mechanism is actuated, such as from a suitable power source, will cause the upper rod section to vibrate in an axial direction with respect to the lower rod section at the aforemention 4,000 strokes per minute and cause an axial movement therebetween of approximately 3/16 of an inch.

It is to be understood that the apparatus may be arranged so that any number of tapes of finishing material 13 may be stacked in superposed relation. In this regard, the jig assembly 6 would be arranged to have a corresponding number of jig heads 7 to support the same number of foils F for engagement with the finishing material 13 for finishing, as aforedescribed.

In regard to all of the above embodiments, a suitable control assembly as well known in the art may be provided for actuating and deactuating the apparatus. Such control assembly may be arranged for separately or simultaneously actuating the fluid cylinder 22 and the vibrating mechanism 12.

The method of the present invention will be fully understood from the following descriptions of the operation of the apparatus 1 of the present invention. Initially, a reel 61, having a strip 13 of unused finishing material wrapped thereon, is mounted on the post 64 and threaded past the block 16 onto the reel 60. The block 16 is then moved to the released position against the pressure of the spring 48 as indicated by the dotted lines at 16 in FIG. 3, and foil F is inserted in the jig head 7. The foil F is rotated to position the blade edge 8*a* toward the block 16 in aligned relation to the cavity 18. The block 16 is then released to position the edge 8*a* in the cavity 18 forcing the strip 13 to deform into the cavity 18 forming a yieldable pocket for the edge 8*a*. The blade edge 8*a* is initially positioned so that it engages the strip 13 in a generally perpendicular relation at the bottom of its stroke, as seen in FIGS. 5 and 6, and the base 8*b* is sufficiently below the strips 13 so as not to engage the bottom edge of the strip 13 at the completion of the upward stroke. The reciprocating mechanism 9 is then actuated, causing the foil F to be reciprocated in a generally upward vertical direction, over a one travel distance at one rate by rod 25 of the fluid cylinder 22 and simultaneously reciprocated back and forth in the axial direction of the rod 25 over a considerably shorter travel distance at a considerably faster rate by the vibrating mechanism 12. The edge 8*a* of the foil F will be cammed in a generally counterclockwise direction, following the angular direction of the cavity 18. At the completion of the upward stroke, the strip 13 will be disposed in substantially tangential relationship with respect to the curved back side of the blade 8 due to the acute angular relationship of the adjacent interior wall portion 76. Upon the reverse downward stroke of the piston rod 25, the foil 8 will be rotated about its lengthwise axis in a clockwise direction, as seen in FIG. 5, and at the completion of its downward movement, the strip 13 will be disposed in substantially parallel relation to the portion of the front side of the blade 8 adjacent the edge 8*a* due to the obtuse angular relationship of the adjacent interior wall portion 77 of the cavity 18 to the front surface 57. This combined reciprocating and vibrating motion is continued until the edge 8*a* has been completely finished to the required tolerances. Should the strip 13 become too used to be effective, the operation may be temporarily terminated, and the block 16 moved to the release position. The driving reel 60 is then rotated so as to draw the strip 13 from the driven reel 61 past the cavity 18 to position an unused portion for engagement with the blade edge 8*a*. The finishing operation may then be completed, as required. On the other hand, should the finishing operation of each blade edge 8*a* be finished before the area of strip 13 being used becomes worn, then the indexing operation, as aforesaid, may be carried out each time a new foil F is positioned in the jig head 7 for finishing. In this manner finishing of the entire edge 8*a* from top to bottom and front to back is achieved in a highly precise and uniform manner.

As previously stated, the apparatus and method of the present invention can be utilized with many different sizes and shapes of foils, and therefore, the various rates and dimensions specified for the components of the apparatus will vary, depending upon the type of foil being finished. Accordingly, any dimensions or rates referred to herein are provided for purposes of clarity of explanation and are not intended to limit the scope of the invention.

I claim:

1. A method for finishing the edge of a foil including the steps of, supporting a foil so as to expose one edge thereof, supporting a flexible finishing material on a support surface for finishing engagement with said edge, maintaining a portion of said finishing material away from said support surface, yieldably applying said portion of said finishing material to conform said finish material to the configuration of said one edge, moving said foil and said finishing material back and forth relative to one another generally in the lengthwise direction of said edge while applying said portion of said finishing material to said edge whereby said finishing material will conform to the configuration of said edge as said foil and said finishing material are moved relative to one another, providing said finishing material in the form of a flat sheet, supporting said finishing material on a support surface in spanning relation over a cavity formed in the support surface whereby said portion of said finishing material is supported away from the interior surface of said cavity, applying said finishing material to one edge of said foil to urge said finishing material and said edge into said cavity, and applying tension to said finishing material in a direction transverse to the direction of said one edge, to maintain said portion of said finishing material out of contact with said support surface and enable it to conform to the configuration of said edge as said finishing material and said foil move relative to one another.

2. A method in accordance with claim 1, including moving said foil and said finishing material relative to one another in one lengthwise direction of said edge, and simultaneously rotating said foil in one rotational direction about one rotational axis extending in the general direction of said one lengthwise direction as said foil and said finishing material move relative to one another to finish said edge toward one side of said foil, moving said foil and said finishing material relative to one another in another lengthwise direction of said edge, and simultaneously rotating said foil in another rotational direction about said rotational axis as said foil and said finishing material move relative to one another in said other lengthwise direction to finish said edge toward the opposite side of said foil.

3. A method in accordance with claim 1, including yieldably applying said finishing material to said foil by forming a yieldable pocket in said finishing material adjacent said portion of said finishing material supported away from said support surface to enable said finishing material to conform to the configuration of said edge as said foil and finishing material move relative to one another.

4. A method in accordance with claim 2, including rotating said foil in said one rotational direction until said finishing material is disposed adjacent said one side of said foil, and rotating said foil in said other rotational direction until said finishing material is disposed adjacent said opposite side of said foil.

5. A method in accordance with claim 2, including rotating said foil in said one rotational direction by cammingly applying said finishing material to said foil in one direction transverse to said rotational axis, and rotating said foil in said other rotational direction by cammingly applying said finishing material to said foil in a direction generally opposite to said one transverse direction.

6. A method in accordance with claim 4, including providing a flat finishing material, rotating said foil in said one rotational direction until said finishing material is substantially tangential to said one side of said foil, and rotating said foil in said other rotational direction until said foil is substantially parallel to said other side of said foil.

7. A method in accordance with claim 1, including moving said foil and said finishing material relative to one another in one lengthwise direction of said one edge, and moving said foil in said one lengthwise direction over one travel distance at one rate and simultaneously moving said foil over a shorter travel distance at a more rapid rate.

8. A method in accordance with claim 2, including moving said foil and said finishing material relative to one another in said lengthwise directions over one travel distance at one rate and simultaneously moving said foil over a shorter travel distance at a more rapid rate.

9. A method in accordance with claim 1, including moving said foil and said finishing material relative to one another generally in the lengthwise direction of said one edge, and rotating said foil about a rotational axis extending generally in the direction of said one lengthwise direction by cammingly applying said finishing material to said foil in a direction generally transverse to said rotational axis as said foil and said finishing material move relative to one another.

10. A method for finishing the edge of a foil including the steps of, supporting a foil so as to expose one edge thereof, supporting a flexible finishing material on a support surface for finishing engagement with said edge, maintaining a portion of said finishing material away from said support surface to enable said portion to deform to the configuration of said one edge of said foil, yieldably applying said portion of said finishing material to said one edge of said foil to deform said finishing material to the configuration of said one edge, moving said foil and said finishing material relative to one another in one lengthwise direction of said edge, simultaneously rotating said foil in one rotational direction about one rotational axis extending in the general direction of said one lengthwise direction as said foil and said finishing material move relative to one another by cammingly applying said finishing material to said foil in one direction transverse to said rotational axis to finish said one edge toward one side of said foil, moving said foil and said finishing material relative to one another in another lengthwise direction of said edge opposite to said one lengthwise direction, and simultaneously rotating said foil in another rotational direction about said rotational axis generally opposite to said one rotational direction as said foil and said finishing material move relative to one another by cammingly applying said finishing material to said foil in a direction generally opposite to said one transverse direction to finish said one edge toward opposite side of said foil.

* * * * *